United States Patent [19]

Thalenfeld

[11] 4,351,440

[45] Sep. 28, 1982

[54] MERCHANDISE HOOK

[75] Inventor: David R. Thalenfeld, Beechurst, N.Y.

[73] Assignee: Trion Industries Inc., Garden City, N.Y.

[21] Appl. No.: 151,357

[22] Filed: May 19, 1980

Related U.S. Application Data

[63] Continuation-in-part of Ser. No. 918,483, Jun. 23, 1978, abandoned.

[51] Int. Cl.[3] ..... A47F 5/00

[52] U.S. Cl. ..... 211/57.1; 40/19.5; 248/220.4; D8/373

[58] Field of Search ..... 211/59.1, 57.1, 54.1; 248/220.3, 220.4, 221.1; D8/373, 363; 40/19.5

[56] References Cited

U.S. PATENT DOCUMENTS

| | | | |
|---|---|---|---|
| D. 249,460 | 9/1978 | Bleed | D8/373 |
| D. 249,461 | 9/1978 | Swinehart et al. | D8/373 |
| 1,033,915 | 7/1912 | McDonald | 211/57.1 X |
| 3,245,547 | 4/1966 | Felkay | 211/59.1 |
| 3,275,272 | 9/1966 | Kirk | 248/220.4 |
| 3,289,993 | 12/1966 | Thalenfeld | 248/220.4 |
| 3,374,898 | 3/1968 | Karmin | 248/221.1 |
| 3,409,260 | 11/1968 | Bleed | 248/221.1 |
| 3,442,396 | 5/1969 | Cass | 211/182 X |
| 3,645,485 | 2/1972 | Gold | 211/59.1 X |
| 3,976,201 | 8/1976 | Hodgson et al. | 211/59.1 |

FOREIGN PATENT DOCUMENTS

| | | | |
|---|---|---|---|
| 2447032 | 4/1976 | Fed. Rep. of Germany | 211/54.1 |
| 1483450 | 8/1977 | United Kingdom | 248/220.4 |

OTHER PUBLICATIONS

Trion Industries, Inc., Point of Purchase Catalog, P. 500, p. 7, "Back Plates", 400 Series.

*Primary Examiner*—Roy D. Frazier
*Assistant Examiner*—Robert W. Gibson, Jr.
*Attorney, Agent, or Firm*—Mandeville and Schweitzer

[57] ABSTRACT

The disclosure relates to a merchandise hook for the display of carded and/or bagged merchandise having highly desirable safety features and being highly compatible with computerized inventory management under the Universal Product Code system. The merchandise hook is formed of a single, continuous wire-like element and includes upper and lower outwardly extending arms. The upper arm is a safety arm and has, at its outer extremity, a downwardly extending guard means, which may in part comprise an integral, downwardly extending portion of the wire. The lower portion of the display hook comprises a merchandise supporting arm, which terminates at least slightly inward of the guard means carried by the upper arm. Typically and desirably, the merchandise supporting arm will terminate in an upwardly inclined end portion, so that the end extremity of the lower wire is located behind and, in some cases, just slightly below the guard means depending from the upper arm. A removable attachment is carried by the safety arm, at its forward extremity, and forms a plate-like label holder. The label holder serves in part to guard and protect the forward extremity of the merchandise hook and also and perhaps more importantly to provide for the display, at the forward-most extremity of the unit, for easy scanning by computer input equipment, of a Universal Product Code label specific to the merchandise on display at the hanger.

13 Claims, 11 Drawing Figures

$152
673451

MERCHANDISE HOOK

RELATED APPLICATIONS

This application is a continuation-in-part of my copending application Ser. No. 918,483, filed June 23, 1978 now abandoned.

BACKGROUND AND SUMMARY OF THE INVENTION

A great deal of merchandise is displayed for sale by means of display hooks mounted on apertured panel board. The arrangement facilitates attractive, easily changeable point-of-purchase display arrangements. On each of a plurality of merchandise display hooks, a plurality of similar items of carded or bagged merchandise are suspended, which may be removed one at a time by customers. A particularly advantageous form of such display hooks is represented by, for example, the Thalenfeld U.S. Pat. No. 3,289,993, owned by Trion Industries Inc. of Garden City, New York.

A characteristic inherent in most forms of panel board display hook arrangements is the outward projection of a wire-like merchandise supporting element of substantial length. This structural configuration, if improperly arranged by store personnel, has a potential to cause injury, in the case of a customer who accidentally falls against the projecting wire. With increasing emphasis being placed upon product safety considerations, significant efforts have been made to improve upon the inherent safety of panel board merchandise display arrangements. One advantageous form of merchandise hook for this purpose is described and claimed in the Karmin U.S. Pat. No. 3,374,898, also owned by Trion Industries Inc. In part, the device of the present invention represents an improvement on the general type of hook shown in the Karmin patent.

In accordance with one objective of the invention, an improved panel board merchandise display hook is provided, in which a wire-like, projecting arm for the support and display of merchandise is integrally associated with a second safety arm, which extends above the merchandise support arm and projects beyond the end extremity of the latter. At the outer end of the safety arm, there is formed or otherwise provided a downwardly extending guard means, which is positioned outward of and slightly above the extremity of the merchandise support arm. The safety arm and guard means effectively shield the tip of the merchandise support arm from accidental contact by a careless customer, at least in a manner that would be likely to cause injury.

In one form of the invention, the plate-like attachment is of molded, plastic construction, having some degree of flexibility or "give" to facilitate absorbing shock. In other forms of the invention, the plate-like attachment may be of extruded, advantageously somewhat more rigid material, which is adapted for attachment to the merchandise display hook in a semi-permanent manner to discourage unauthorized removal and/or exchange of product information coding.

In one form of the new merchandise display hook, a merchandise supporting arm and an outwardly projecting safety arm as above described, is formed of a single, continuous length of wire, of generally U-shaped configuration. The base portion of the U-shaped article is, in the operative position of the device, placed in vertical orientation against an apertured panel display board. An advantageous form of pivoting lug plate is carried by the base portion of the wire and is provided with upwardly extending, generally L-shaped lugs arranged to pass through apertures in the panel and, when pivoted into upright position, to lock the display hook in position thereon. In part, the novel mounting arrangement makes use of design features heretofore known. However, the arrangement is particularly well suited to the device of the invention, involving spaced upper and lower, outwardly extending arms, which are connected by an integral vertically extending base portion. In the arrangement of the invention, the pivoting lug-mounting plate is arranged to straddle the vertical base portion and to accommodate its vertical passage entirely through the region of the lug-mounting plate.

In accordance with one aspect of the invention, a novel and advantageous plate-like attachment is provided, for mounting on the extreme end area of the safety arm. Importantly, the plate-like device forms a label holder for a Universal Product Code information label, carrying product pricing and inventory information. The nature and location of the label holder is such as to place the label in a highly prominent position, out in front of the suspended merchandise, not only that of the particular display device in question, but also that of the neighoring devices, both above and to the side. The label-holding plate not only provides prominently displayed price and product information for the convenience of the customer, but also is formed with an optical scanning wand guide flange. This provides practical instrument-readability of the product information, to enable high speed, computer terminal input of product information for inventory purposes. In this respect, although the Universal Product Code system is coming into increasingly widespread use, it has been, up to this time, difficult and impracticable to utilize the Universal Product Code system for inventory purposes with respect to rack-support merchandise, as is contemplated by the present invention.

The label-holding device of the present invention not only provides a convenient and highly efficient facility for partially automated utilization of the Universal Product Code system, but in addition provides for improved safety in the wire hook display or rack merchandise. The extruded form of label holder provides for a high degree of flexibility to meet customer needs and desires, while enabling the product to be marketed at low cost.

For a more complete understanding of the above and other features and advantages of the invention, reference should be made to the following detailed description of a preferred embodiment and to the accompanying drawings.

DESCRIPTION OF A PREFERRED EMBODIMENT

Figures 1, 2, 3, 4, 5, 6:
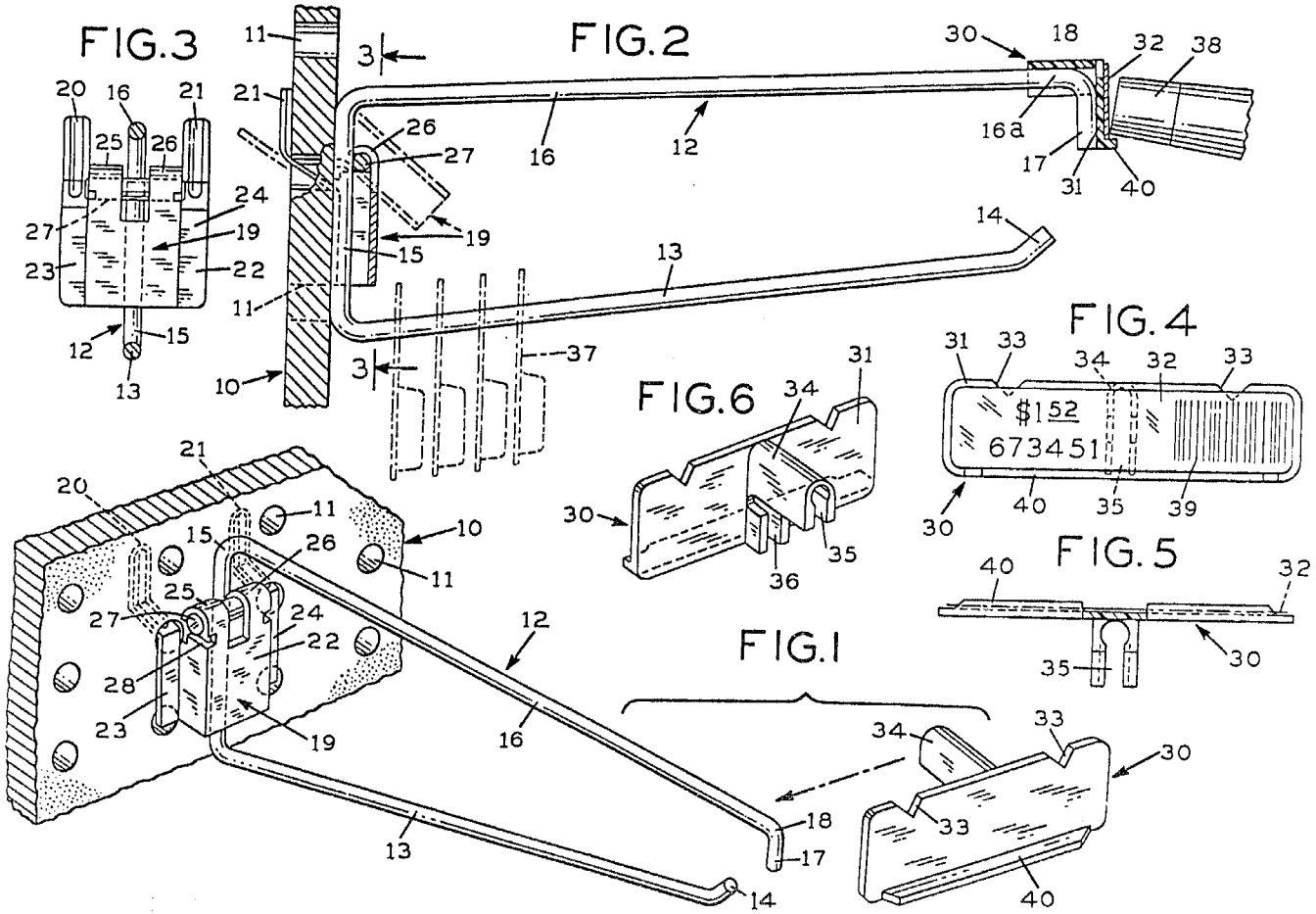
FIG. 1 is an exploded, perspective view of a novel panel board supported merchandise hook according to one form of the invention, illustrating one advantageous form of product code label holder for use in connection therewith.
FIG. 2 is a side elevational view, partly in section, of the device of FIG. 1.
FIG. 3 is a cross sectional view, taken generally along line 3—3 of FIG. 2.
FIGS. 4, 5 and 6 are, respectively, a front elevational view, a bottom plan view, and a back perspective view of a novel form of product code label holding device adapted particularly for use in connection with the merchandise hook of FIG. 1.
Figure 7:
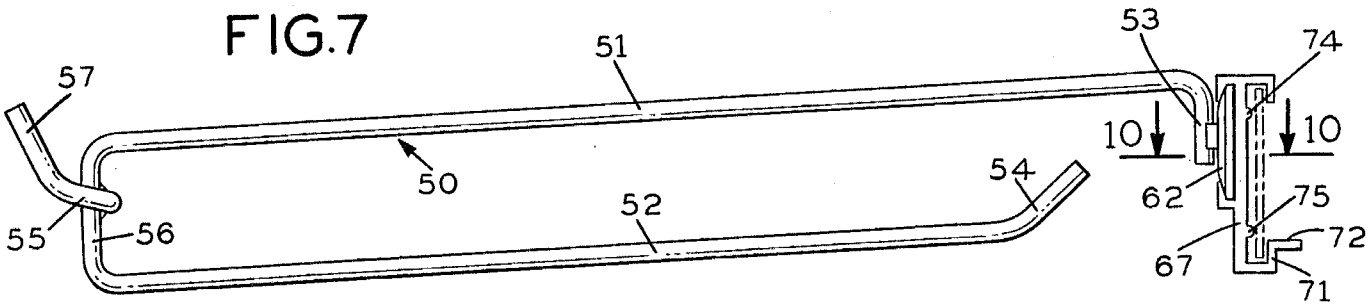
FIG. 7 is a side elevational view of a second advantageous form of display hook incorporating features of the invention.
Figure 8:
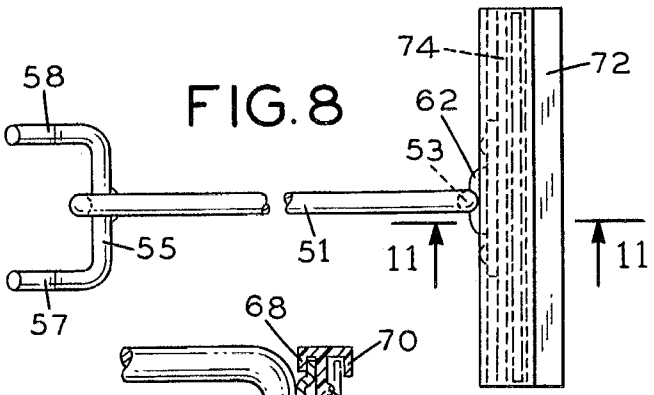
FIG. 8 is a top plan view of the device of FIG. 7, with parts broken away.
Figure 11:
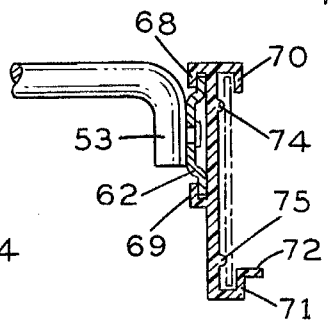
FIG. 11 is a cross sectional view as taken generally on line 11—11 of FIG. 8.
Figure 9:
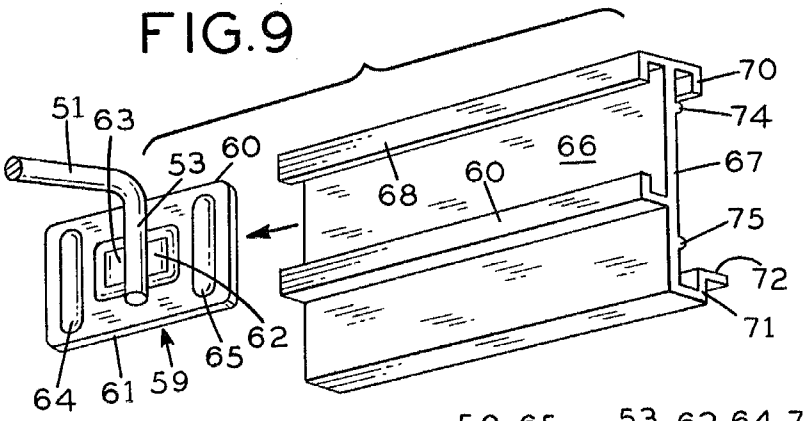
FIG. 9 is a fragmentary perspective view of the device of FIG. 7, illustrating the manner in which the label-holding plate is mounted to the safety arm of the merchandise hook.
Figure 10:
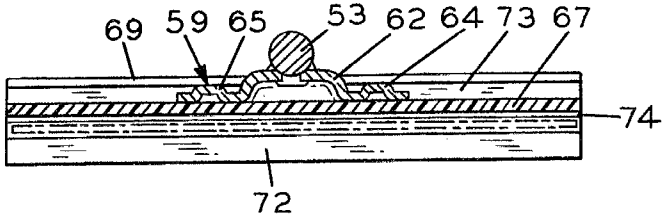
FIG. 10 is a cross sectional view as taken generally on line 10—10 of FIG. 7.

Referring now to the drawings, the reference numeral 10 designates generally an apertured panel board of conventional construction, provided with a plurality of regularly spaced openings 11. A display hook assembly, generally designated by the reference numeral 12, is arranged to be mounted on the panel board 10 by engagement with the openings 11 in a manner generally known.

Pursuant to one aspect of the invention, the display hook 12 comprises a continuous wire-like element formed into a generally U-shaped configuration. The U-shaped wire includes a lower, outwardly extending merchandise supporting arm 13. Typically, the supporting arm 13 is inclined slightly upwardly in a direction away from the panel board, and terminates at its outer extremity in an upwardly inclined tip portion 14. At the closed end of the U-shaped wire, there is a vertically disposed base portion 15, which connects integrally with the support arm 13, at its lower end, and with a safety arm 16. The safety arm 16 extends outwardly from the panel board 10, directly over the merchandise support arm 13, to a point at least slightly beyond the end extremity 14 of the latter.

At its outer end, the safety arm 16 carries a guard portion 17, most advantageously in the form of a downwardly bent integral end portion of the wire. As shown particularly in FIGS. 1 and 2, the downwardly extending guard portion 17 terminates at a point slightly above and slightly outward of the end 14 of the lower wire. The arrangement is such that the otherwise exposed lower tip portion 14 is effectively shielded from accidental contact, by means of the downwardly projecting guard portion 17. In this respect, the exposed upper portions of the safety arm 16 and guard portion 17 are generously rounded, as at 18, so that accidental customer contact with the upper section of the wire is generally harmless.

For mounting the hanger unit 12 onto the panel board 10, there is provided, in accordance with principles of the before mentioned Thalenfeld U.S. Pat. No. 3,289,993, a pivoting lug plate 19 from which extend a pair of spaced, generally upwardly extending L-shaped lugs 20, 21. The lug plate 19 is of stamped, sheet metal construction, and the main or body portion 22 thereof has a generally U-shaped cross sectional configuration, as is evident in FIG. 1. At each side, there are integral, outwardly bent wing flanges 23, 24, extensions of which form the upstanding lugs 20, 21. Along its upper edge, the lug plate 19 is provided with arcuate tabs 25, 26; these engage a crossbar 27, which is welded to the base portion 15 of the U-shaped wire. The opposite side of the crossbar 27 is engageable by shoulders 28, constituting the upper end surface of the side panels of the sheet metal body 22. The arrangement is such that the lug plate 19 is freely pivotable about the crossbar 27 to facilitate insertion of the lugs 20, 21 into the panel board openings 11, without requiring upward tilting of the hanger unit as a whole. Indeed, because the lug plate 19 is permitted to pivot, it is possible to permit the base portion 15 of the U-shaped wire to extend considerably above the level at which the lugs pass through the panel board (see FIG. 2) without interfering with the proper operation of the device.

As reflected in FIG. 2, the U-shaped cross sectional configuration of the lug plate 19 is such as to form in effect a tunnel-like cavity, enabling the base portion 15 of the U-shaped wire to pass entirely through the lug plate, projecting well above and well below the upper and lower extremities of the lug plate, as indicated in FIG. 2. This is particularly advantageous in conjunction with the specific wire form incorporated in the device of the invention, which includes both upper and lower outwardly extending wire sections. Although the specific configuration of lug plate 19 illustrated herein is considered to be part of the prior art, its prior utilization, insofar as is known, has been limited to so-called single arm hooks, in which a single wire hook element projects upward, above the crossbar and then outward of the panel to form a merchandise supporting hook. A short base portion extends downward, below the crossbar, to provide stabilization and support for the hook. The present construction admits of a single, continuous, U-shaped wire providing both safety and product supporting portions above and below the panel engaging lugs, and at the same time providing for pivoting operation of the lugs to permit straight-in entry of the device as a whole when mounting on or demounting from the panel board.

Pursuant to another specific aspect of the invention, a plate-like label holding means is mounted at the other extremity of the display hook 12, specifically at the end extremity of the safety arm 16. The label-holding element, identified generally by the reference numeral 30, may serve in a dual capacity of providing substantial safety protection at the exposed outer end of the device and also to provide a highly accessible and convenient means of identifying the displayed merchandise for the consumer and for scanning by automatic inventory terminals utilizing the Universal Product Code system. The product information and pricing is prominently displayed, well out in front of the merchandise itself, for easy viewing.

In the form of the label holder 30 shown in FIGS. 4–6, the holder is desirably of molded plastic construction, comprising a generally flat front panel 31 of a size and shape appropriate to receive a Universal Product Code label 32. Frequently, such product code labels are provided with a pressure sensitive adhesive, in which case they may simply be adhered to the front surface of the panel 31. Notches 33 may be provided in the panel to facilitate removal of the label when charging the product information. In other instances the panel 31 may be formed with upper and lower flanges (not shown) for the endwise slideable reception of a product code label, in which case the label is mechanically, rather than adhesively, retained.

Extending integrally from the rear of the panel 31 is a mounting bracket 34 provided with horizontally and vertically extending grooves 35, 36 for the reception of end portions 16*a*, 17, 18 (FIG. 2) of the upper wire. The grooves 35, 36 desirably are contoured to snap firmly on the end of the wire, being removable only with rather considerable force, to minimize unauthorized removal of the label holder.

As shown in FIG. 2, when the label holder is in position on the upper wire 16, the label 33 is conspicuously presented to the customer, above and in front of the suspended merchandise packages 37. Any product pricing and other information is thus prominently displayed and conveniently viewable by the customer. More significantly perhaps, the product label 32 is immediately and conveniently accessible for reading by a scanning wand 38 of a conventional code reading portable input terminal. In a typical automated inventory operation, an operator carrying a portable electronic recorder may scan the bar code portion of the label 32 by moving the wand 38 laterally across the front face of the label to scan and register the product code information 39. To facilitate this scanning operation, the label holder 30 is provided along its lower edge with guide lip 40 upon which the wand 38 may be rested and guided during scanning movement. After the scanning operation is complete, the recorder will contain the necessary inventorying information related to the particular product supported by the display device 12. The operator then supplements that information with the number of items left on display to provide a rapid, computer-processable inventory count.

The basic system for inventorying under the Universal Product Code system is, of course, well known and forms no part of the present invention. It has been difficult heretofore, however, to perform such inventorying operations with respect to hanger displayed merchandise, because of the difficulty in gaining access to the product information label, typically located on or near the apertured panel 10. In accordance with the present invention, the product label is conveniently supported at a point forward of the displayed product and constituting the forwardmost extremity of the display hanger as a whole, so that inventorying operations may be quickly and smoothly accomplished.

Additionally and importantly, the product code label holder 30, being positioned at the forwardmost extremity of the hanger unit, and above and forward of the extremity 14 of the product supporting arm 13, contributes importantly to the overall safety of the unit against accidental customer contact. In one sense, the label holder contributes to safety by providing a highly visible, eye-catching object, constituting the forwardmost and most accessible extremity of the device. By contrast, a wire-like element, viewed straight on from the end, sometimes is not easily noticed if the eye is focused to a different depth. Further, the label holder element, being formed of a molded plastic material, such as polypropylene, polyethylene, polyvinyl chloride or the like, inherently has somewhat more resilience and "give" than the wire itself, at least to end-on contact. Accordingly, the likelihood of injury incurring by any accidental contact with the device, when carrying the label holder 30, is very greatly minimized.

In a modified form of the invention, shown in FIGS. 7–11, a wire-like merchandise hook 50 of U-shaped configuration is formed with an upper safety arm 51 and a lower, product supporting arm 52. To advantage, the safety arm 51 has a downturned portion 53 at its outer extremity, which is located forward of and typically above the upturned outer end extremity 54 of the product supporting arm. In the modification under construction, a generally U-shaped mounting element 55 is welded or otherwise permanently secured to the base portion 56 of the U-shaped element and is provided with spaced mounting lugs 57, 58 for reception in an apertured display panel. It will be understood, of course, that the pivoted mounting lug arrangement of the embodiment of FIGS. 1–6 may be utilized if desired. Thus, the mounting arrangement of FIGS. 1–6 has certain functional advantages, at greater manufacturing costs, while the mounting arrangement of FIGS. 7–11 has the advantage of simplicity and lower manufacturing cost.

In the modified device of the invention, a mounting plate 59 is welded to the front of the downwardly extending portion 53 of the safety arm. The mounting plate 59 is generally rectangular in configuration, having upper and lower edges 60, 61 which are desirably parallel and horizontal when the device is properly mounted. In general, the plate 59 is oriented in a plane approximately at right angles to the axis of the safety arm 51, so as to be more or less vertically oriented when the device is mounted in its normal display position.

In the illustrated arrangement, the mounting plate 59 is provided in its center area with a stamped depression area 62, which is offset slightly to the rear and forms an arcuate saddle 63, for more secure attachment of the plate to the wire portion 53. Adjacent each lateral edge, the mounting plate 59 is provided with vertically extending, rearwardly projecting stamped-in ribs 64, 65, the upper and lower ends of which extend near to but typically short of the upper and lower plate edges 60, 61.

Pursuant to one aspect of the invention, a label holder element 66 is provided, which is of a constant cross section, suitable for continuous production by extrusion techniques, followed by severing to any appropriate predetermined length. In a typical device according to FIGS. 7–11 hereof, the length of the label holder 66 approximately corresponds to the length of a standard size label utilized in the Universal Product Code labeling system, which in turn may be and usually is considerably longer than the mounting plate 59. By way of example only and not of limitation, the length of the mounting plate 59 may be on the order of 2.5 cm, while a typical length of the label holder 66 may be on the order of 6.3 cm. As reflected in FIGS. 7, 9 and 11 in particular, the label holder 66 is extruded in a form to provide a main panel wall 67, upper and lower inturned rear flanges 68, 69, upper and lower inturned front flanges 70, 71 and a forwardly projecting horizontal guide flange 72 along the bottom edge. The rear flanges 68, 69 are offset behind the main panel 67 sufficiently to receive the upper and lower edge margins of the mounting plate 59 relatively closely. In addition, the rear flanges 68, 69, which may be referred to as mounting flanges, extend toward each other sufficiently to overlap slightly the end extremities of the rearwardly displaced vertical ribs 64, 65 of the mounting plate. Desirably, the normal space 73 (see FIG. 10) between the main panel 67 and the mounting flanges 68, 69 is equal to and perhaps slightly greater than the thickness of the mounting plate 59 at its upper and lower extreme margins, but is narrower than the thickness of the plate in the region of the ends of the vertical ribs 64, 65. Accordingly, when the label holer 66 is applied to the mounting plate 59 by inserting the mounting plate 59 laterally into the slot formed by the mounting flanges 68, 69, the mounting plate is gripped tightly by the edge extremities of the mounting flanges 68, 69 overlapping and pressing tightly on the end extremities of the ribs 64, 65. The described arrangement is simple, inexpensive, capable of accommodating typical manufacturing tolerances in the manufacture of the mounting plate 59 and the extruded label holder 66 and is effective in discouraging unauthorized removal of the label holders after assembly. At the same time, the friction is not so great as to make difficult the assembly of the label holder to the mounting plate.

At the front of the label holder 66, the front flanges 70, 71, which may be referred to as label mounting flanges, define a slot of suitable height to receive a standard size label. Longitudinal ribs 74, 75 are provided along the front face of the panel 67, projecting outward therefrom. Desirably, the forward projection of the ribs 74 is such, in relation to the spacing of the flanges 70, 71 from the panel 67, as to cause a slight forward bowing of a label 76 to increase its frictional engagement with the label holder. Of course, it is possible to utilize an adhesive label where that is desired, in which case the label holding flanges may be omitted, as in the device of FIGS. 1–6.

In any of its forms, the merchandise display hook of the invention has substantial advantages. The label holding plate, mounted at the outer end of the safety arm, provides for greatly increased visibility of the outermost extremity of the device, so as to reduce the likelihood of customer contact and resulting possible injury. Of great significance, the label holder, mounted at the forwardmost extremity of the display device and provided with a guide flange for the support and guidance of an optical reading wand, provides a highly advantageous arrangement for partial automation of inventory control using Universal Product Code labeling procedures. By locating the label holder out at the forwardmost extremity of the display unit, product pricing and information is prominently displayed, readily visible, and easily accessible for the scanning procedures required in automated inventory control.

In the form of the label holding device utilized in the embodiment of FIGS. 1–6, the label holder is of molded construction and may be removably attached to the hanger assembly. This permits the ultimate user to install the label holder or not, as suits the particular merchandising plan and/or safety policy. Whether the label holder is installed or removed, the device provides basic safety features, as set forth in the before mentioned Karmin U.S. Pat. No. 3,374,898. However, the presence of a relatively large label holder, prominently forward in the forwardmost position, affords maximum protection, as will be appreciated.

In the modification shown in FIGS. 7–11, the display hanger is intended to be used at all times with the label holder 66. The label holder and mounting means is designed to be rugged and reliable, yet capable of manufacture at very low cost. The extruded construction of the label holder 66 accommodates such low cost production objectives particularly well. With a given extrusion, label holders may easily be cut to any desirable length. In addition, extrusion dies are very inexpensive, so that specific customer needs and desires can be easily met.

In the arrangement of the FIGS. 7–11, the extruded label holder 66 is designed for close, tight slideable interfitting with the mounting plate 59. The design of the mounting plate with spaced vertical ribs, provides a simple, expedient yet highly effective arrangement for the semi-permanent mounting of the extruded plastic label holder 66 on to the metal hanger device. The arrangement is well suited to the rather wide manufacturing tolerances inherent in the production techniques employed.

In the device of FIGS. 1–6, the illustrated label holder is designed specifically for adhesively mounted Universal Product Code labels, in which case a separate guide flange 40, along the lower edge of the label holder serves to guide the optical reading wand properly across the label data. In the device of FIGS. 7–11, the lower flange 72 serves the same purpose. However, it may in some cases be feasible to design the lower label holding flange 71 to have sufficient thickness that it may serve in the capacity of a wand guide.

In either illustrated form of the invention, the label holder is positioned to extend primarily downward from the outer end of the safety arm, having minimum upward projection from the upper limits of the safety arm. This is important in minimizing interference with the removal of merchandise from an adjacent, higher merchandise supporting arm.

It will be recognized that the specific forms of the invention herein illustrated and described are intended to be representative only, and certain changes may be made therein without departing from the clear teachings of the disclosure. Accordingly, reference should be made to the following appended claims in determining the full scope of the invention.

I claim:

1. A merchandise hook for mounting on a display panel, which comprises (a) a continuous wire-like element shaped into a generally U-shaped configuration, (b) said wire-like element including a lower, outwardly projecting merchandise supporting arm and an upper, outwardly projecting safety arm, (c) said safety arm extending outwardly beyond the end of said merchandise supporting arm, (d) guard means extending downward from the end of said safety arm, and having minimum upward projection from the upper limits of said safety arm, (e) said merchandise supporting arm having an upwardly tilted end extremity terminating inwardly of said guard means, (f) said wire-like element further including a vertical base portion connecting said merchandise supporting arm and said safety arm, and (g) lug means on said base portion for engagement with an apertured display panel, (h) said guard means comprising a plate-like label holder formed of deflectable plastic material carried by the outer end extremity of said safety arm, (i) said safety arm having an integral, downturned end extremity terminating outward of the end extremity of said supporting arm, and (j) said guard means comprising in part a plate-like holder carried by said downturned end extremity, (k) said label holder comprising the forwardmost extremity of said merchandise hook, (l) said label holder having an integral, wand-supporting flange along its lower portion and a label supporting portion above said flange.

2. A merchandise display hook for panel displays, which comprises (a) a continuous, generally U-shaped wire-like element having a lower, article-supporting arm and an upper, safety arm, and (b) a plate-like label holder mounted transversely on said safety arm and being formed of a deflectable plastic material, (c) said article-supporting arm having its outer end extremity positioned behind and slightly below said label holder whereby to be guarded and protected thereby, (d) said plate-like label holder extending generally downward from said safety arm and having a minimum upward projection from the upper limits of said safety arm, (e) said label holder having a guide flange along its lower edge area for supporting and guiding an information reading scanning element or the like.

3. A merchandise hook for mounting on a display panel, which comprises (a) wire-like elements forming a lower outwardly projecting merchandise support arm and an upper, outwardly projecting safety arm, (b) said safety arm extending outwardly above and forwardly of the end extremity of said merchandise supporting arm, (c) a combined guard means and label holder extending downward and laterally from the end of said safety arm, and having minimum upward projection from the upper limits of said safety arm, (d) said merchandise supporting arm having an end extremity terminating inwardly of said guard means, (e) a vertical base portion connecting said merchandise supporting arm, (f) lug means on said base portion for engagement with an apertured display panel, and (g) said label holder having a forwardly projecting guide flange along its lower edge area for supporting and guiding an information reading scanning element or the like.

4. A merchandise display hook for panel displays, which comprises (a) a continuous, generally U-shaped wire-like element having a lower, article-supporting arm and an upper, safety arm, and (b) a plate-like label holder mounted transversely on said safety arm and being formed of a plastic material, (c) said article-supporting arm having its outer end extremity positioned behind said label holder whereby to be guarded and protected thereby, (d) said plate-like label holder extending generally downward from said safety arm and having a minimum upward projection from the upper limits of said safety arm, (e) said label holder having a guide flange along its lower edge area for supporting and guiding an information reading scanning element or the like.

5. A merchandise hook according to claim 4, further characterized by (a) a mounting plate being rigidly secured to the outer end of said safety arm, (b) said label holder comprising an extruded section of predetermined length having upper and lower, rearwardly projecting mounting flanges adapted for tight slideable engagement with said mounting plate.

6. A merchandise hook according to claim 5, further characterized by (a) said mounting plate being of metal construction, having upper and lower edges and horizontally spaced rearwardly projecting vertical ribs extending to areas adjacent said upper and lower edges, and (b) said upper and lower mounting flanges having portions overlying and frictionally gripping the end areas of said vertical ribs.

7. A merchandise hook according to claim 5, further characterized by (a) said label holder including a label supporting panel extending generally from the region of said upper mounting flange to a level below said lower mounting flange.

8. A merchandise hook according to claim 7, further characterized by (a) said panel having upper and lower label retaining flanges and a horizontal wand guide flange adjacent the lower edge of said panel.

9. A merchandise hook according to claim 7, further characterized by (a) said panel having a horizontal wand guide flange adjacent its lower edge.

10. A merchandise hook according to claim 7, further characterized by (a) said label holder being extruded from a material such as high impact styrene.

11. A merchandise hook according to claim 7, further characterized by (a) said mounting plate being a generally flat metal plate having generally horizontal upper and lower edges, (b) said upper and lower mounting flanges being slideably received over and frictionally gripping said mounting plate in the region of said upper and lower edges.

12. A merchandise hook according to claim 11, further characterized by (a) said mounting plate having a limited number of forwardly or rearwardly displaced areas in the regions of said upper and lower edges, (b) said displaced areas being engageable by and frictionally restraining said upper and lower mounting flanges.

13. A merchandise hook according to claim 11 further characterized by (a) said mounting plate being of substantially smaller length and height dimensions than said label holder.

* * * * *